US005094158A

United States Patent [19]

Melandri et al.

[11] Patent Number: 5,094,158

[45] Date of Patent: Mar. 10, 1992

[54] DIAPHRAGM PRESS WITH INTERNAL WASH SYSTEM

[75] Inventors: Francesco Melandri; Primo Melandri, both of Lugo Di Romagna, Italy

[73] Assignee: Diemme S.p.A., Ravenna, Italy

[21] Appl. No.: 765,501

[22] Filed: Sep. 26, 1991

Related U.S. Application Data

[63] Continuation of Ser. No. 446,446, Dec. 5, 1989, abandoned.

[51] Int. Cl.[5] ..... B30B 9/22

[52] U.S. Cl. ..... 100/112; 99/495; 100/125; 100/211; 134/169 R

[58] Field of Search ..... 100/104, 110, 112, 116, 100/125, 126, 211; 134/166 R, 169 R, 171; 99/495; 366/138

[56] References Cited

U.S. PATENT DOCUMENTS

| | | | |
|---|---|---|---|
| 3,513,769 | 5/1970 | Sutter-Christ | 100/112 X |
| 4,106,404 | 8/1978 | Schmid | 100/211 X |
| 4,140,051 | 2/1979 | Hauser et al. | 100/211 X |
| 4,844,799 | 7/1989 | Lee | 100/112 X |
| 4,913,819 | 4/1990 | Patterson | 134/171 X |

FOREIGN PATENT DOCUMENTS

| | | | |
|---|---|---|---|
| 446200 | 6/1927 | Fed. Rep. of Germany | 134/171 |
| 1013517 | 8/1957 | Fed. Rep. of Germany | 100/211 |
| 2027356 | 2/1980 | United Kingdom | 100/112 |

*Primary Examiner*—Harvey C. Hornsby
*Assistant Examiner*—Stephen F. Gerrity

[57] ABSTRACT

A diaphragm press comprises a cylindrical vessel (7) rotating about its longitudinal axis and divided into two diametrically opposing parts by a flexible diaphragm (8). A series of perforated longitudinal channels (10) is fixed to a part of the inner surface of the vessel and connected at one end to an external manifold (12) for collecting the juice. At their other end, the channels (10) are connected to at least one further manifold (15) which is connected to a pumping unit (99) for feeding water under pressure by way of valves (160). The flexible diaphragm (8) is of such dimensions as to perfectly mate with the wall to which the channels (10) are connected and with the channels themselves so as to perfectly close the holes (100) of these channels (10) when the diaphragm is thrust from its rear by the pressurized fluid.

6 Claims, 2 Drawing Sheets

DIAPHRAGM PRESS WITH INTERNAL WASH SYSTEM

This application is a continuation of application Ser. No. 07/466,446 filed on Dec. 5, 1989, now abandoned.

BACKGROUND OF THE INVENTION

In the enological field so-called diaphragm presses are known consisting of a cylindrical vessel rotating about its longitudinal axis and divided into two parts by a deformable diaphragm disposed in proximity to the vessel axis and substantially parallel thereto.

One part of the vessel is intended to receive a pressurized fluid and its other part is intended to receive the product to be pressed.

Presses of this type are also known in which the juice pressed from the product is collected through perforated channels in the inner wall of the vessel which feed the juice either to a common external manifold or to a closed false bottom located at one end of the vessel.

One of the main problems encountered in the use of diaphragm presses of the aforesaid type is the need to wash said collection channels to prevent stagnant juice lying therein undergoing undesirable fermentation while the press is inactive, and harming the product obtained when the press is again operated.

Any solution to this problem is aggravated by the fact that said channels are inaccessible from the outside.

SUMMARY OF THE INVENTION

The object of the present invention is to provide a diaphragm press comprising simple means operable in accordance with an automatic cycle to ensure perfect washing of the juice collection channels.

This object is attained by a press comprising a vessel having a deformable diaphragm and perforated longitudinal channels. An external manifold is connected to one of the ends of the channels to collect juice formed in the vessel. A second manifold is connected to the other ends of the channels for admitting water from a feeding means to the vessel. Valve means are provided to regulate the flow of water and the diaphragm is of such dimensions as to mate with at lest a portion of the vessel's inner wall and the channels. Each of the channels have a plurality of holes defined therein which are closeable by the diaphragm when the diaphragm mates with the channels.

Further scope of applicability o the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The merits and the operational and constructional characteristics of the invention will be apparent from the detailed description given hereinafter with reference to the figures of the accompanying drawings which show a preferred embodiment hereof by way of non-limiting example, and wherein.

DETAILED DESCRIPTION OF THE PREFERRED EMBODIMENTS

Figure 2:
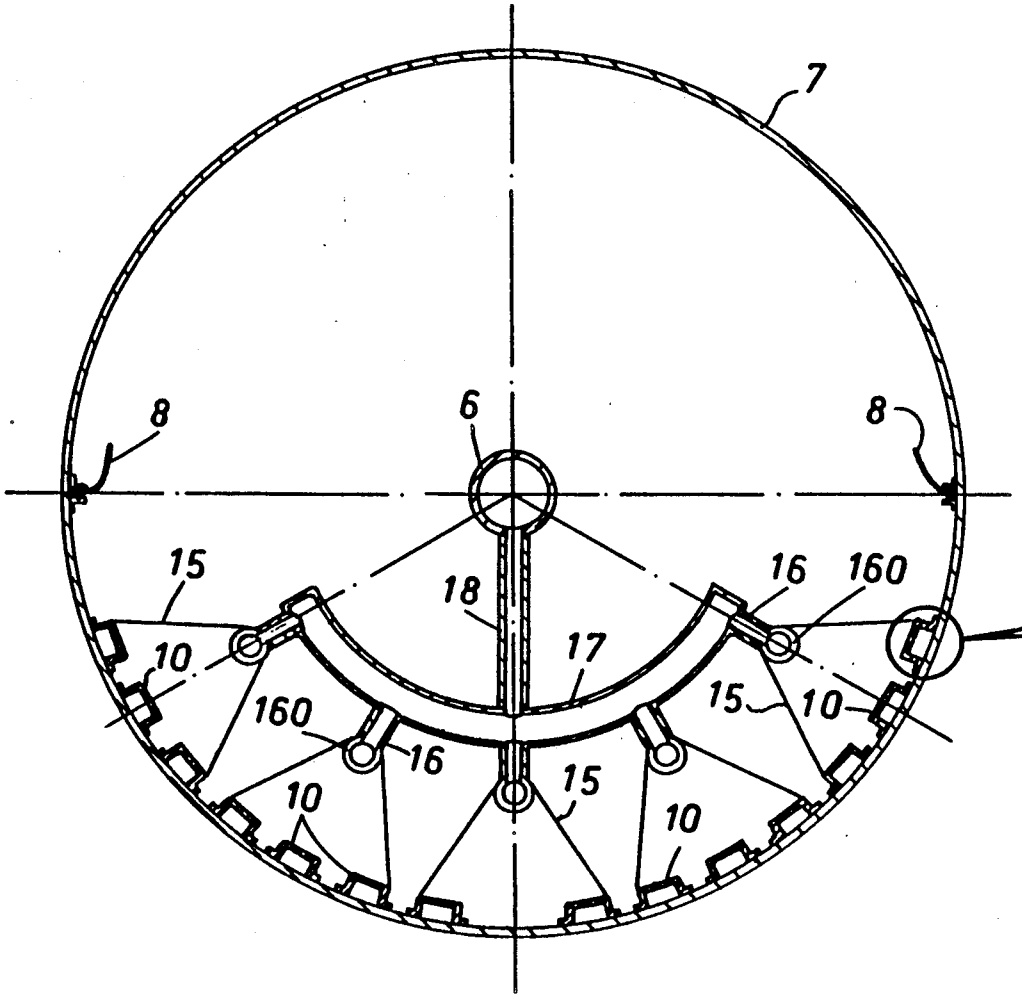
FIG. 2 is a section on line II—II of FIG. 1 to an enlarged scale.

The figures, and in particular FIG. 2 show two opposing pairs of side-by-side uprights 1, 2 connected at a bottom portion thereof by a strong horizontal frame 22.

At the top of said two pairs of uprights 1, 2 respective supports 3 and 4 are disposed in which two hollow coaxial journals, 5 and 6 respectively, are rotatably mounted. These journals 5 and 6 are fixed to the center of the ends of a cylindrical vessel 7 in which a longitudinally extending flexible diaphragm 8 is disposed. The flexible diaphragm 8 is formed of a convenient impermeable material suitable for food use and is fixed in a sealed manner at its periphery to the inner surface of the vessel 7 by known means.

In this manner the diaphragm 8 divides the vessel 7 into two diametrically opposite parts, of which one (the lower one in FIGS. 1 and 2) is intended to contain the product to be pressed, whereas the other (the higher one in said figures) is intended to be connected to a compressor/vacuum unit. The compressor/vacuum unit indicated schematically at 44 in FIG. 1, is intended to put the region behind the diaphragm 8 under vacuum and also to put the same region under pressure in the manner well known to experts of the art and therefore not described as its does not form part of the invention.

The compressor/vacuum unit 44 is connected to the vessel 7 by a sealed rotary coupling 33 associated with the hollow journal 6 (see FIG. 1), the product to be pressed being loaded, again by way of a rotary sealed coupling (not shown), through the hollow journal 5. This hollow journal 5 is intended to be connected to a convenient feed pump, not shown. Also, the hollow journal 5 is associated in known manner with a pressure switch arranged to feed a signal for halting said pump when the chosen working pressure is reached in the vessel 7, and a bag valve which seals the journal 5 after stoppage of the feed pump. In addition, to the side of the support 4 there is a self-braking geared motor unit with two or more speeds able to operate both continuously and intermittently to drive a chain which passes about a sprocket 9 fixed to the journal 6 (FIG. 1).

With the pair of uprights 1 there is associated a central control unit 66 which can be of electrical or electronic type and by which the pressing cycles can be selected on the basis of the characteristics of the product to be pressed. The control unit 66 also automates the wash stage described hereinafter.

Figure 1:
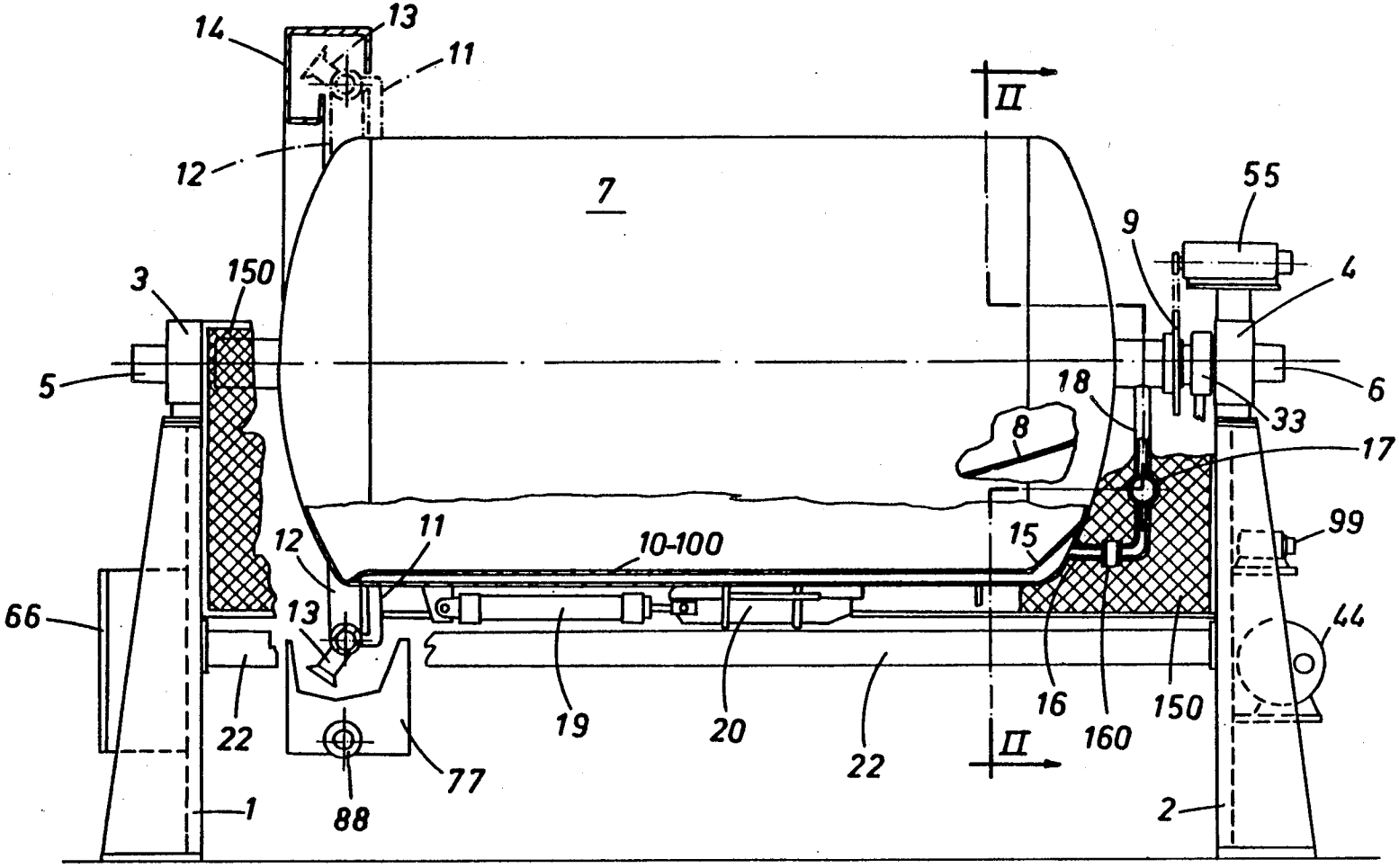
FIG. 1 is a side view of the invention with parts shown in section.
Figure 3:
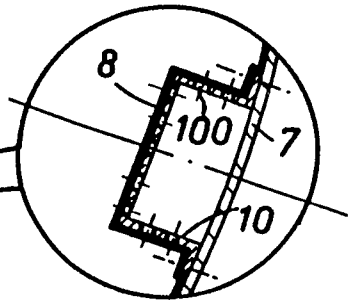
FIG. 3 is a cross-section through a drainage channel during the final wash stage, to an enlarged scale.

With reference to FIGS. 1 to 3, to evacuate the juice there is fixed on the inner surface of the vessel 7 a plurality of longitudinal drainage channels 10 each provided with a multiplicity of small slots 100 or holes (see FIG. 3) through which the juice passes. In the case shown, there are fourteen drainage channels (10) (see FIG. 2) but their number can obviously vary.

At one end, each individual channel 10 communicates by way of a corresponding external elbow 11 with a manifold 12 in the form of an open ring and comprising a series of discharge ports 13. These ports 13 are directed towards an annular collection element 14 supported by a guard 150 secured to the frame 22, and is arranged to convey the juice to an underlying tray 77, provided with a discharge outlet 88. At their opposite end, the four lateral groups of three channels 10 and the central pair of adjacent channels 10 (see FIG. 2) communicate with respective secondary manifolds 15 for collecting the wash water, these being connected to a main manifold 17 by an external elbow 16. Said elbows 16 are valved by corresponding solenoid valves 160 controlled by the central control unit 66. From the main manifold 17, a branching feed pipe 18 is connected to the hollow journal 6. Finally, said journal 6 is connected by way of a rotary sealed coupling (not shown) to a pumping unit 99 (FIG. 1) controlled by the central control unit 66 and connected to a convenient source of water.

On termination of the pressing cycle, the vessel 7 is as shown in FIG. 1, a vacuum then being created behind the diaphragm 8 (FIG. 2) and the pneumatic piston-cylinder unit 19 receiving the enabling signal to withdraw the cover 20 (see FIG. 1) to uncover a lateral mouth provided on the vessel 7 through which the grape cake is discharged.

With reference to FIG. 2 it should be noted that said discharge mouth for the grape cake lies between the central channels 10 of said series of channels.

No further constructional details of the cover 20 will be given as these are known.

After discharging the grape cake the cover 20 is closed again and air is fed behind the diaphragm 8. At the same time the pumping unit 99 receives the enabling signal to start, and the valves 160 are opened in succession for a predetermined period, of such a length as to enable all the valves to open and then close before a convenient pressure, such as of the order of 0.3–0.4 bar, has built up behind the diaphragm.

This enables the air thrust by the diaphragm 8 to mix with the water, leading to a more effective and/or careful cleaning/washing action for the channels 10. When said pressure has built up behind the diaphragm the valves 160 are again made to open in succession for a predetermined period which can be selected at will through the central control unit 66, after which, when the last valve 160 of the series has closed, the pumping unit 99 stops.

The diaphragm 8 is of such a size as to exactly mate with the outer profile of the channels 10 and the corresponding connection wall so that during the final wash stage the slots or holes 100 are closed. This can be seen in FIG. 3.

The objects and advantages of the invention are clear from the a foregoing and from an examination of the accompanying figures.

The invention is not limited to the single illustrated and described embodiment, and can comprise all technical equivalents to the aforesaid means and their combinations if implemented within the context of the following claims.

We claim:

1. A diaphragm press comprising:

a generally cylindrical vessel having a longitudinal axis, the vessel being rotatable about the longitudinal axis;

a deformable diaphragm positioned in the vessel, the diaphragm dividing the vessel into two parts and having a rear side upon which a pressurized fluid acts;

perforated longitudinal channels provided in one of the parts of the vessel along an inner wall thereof, said channels having first and second ends and having a plurality of holes defined therein;

an external manifold connected to the first ends of the channels, juice from the vessel being collected in the external manifold;

a second manifold connected to the second ends of the channels;

means for feeding water under pressure through the second manifold to the channels, sad means for feeding being operatively connected to the second manifold;

valve means positioned between the means for feeding and the second manifold for regulating flow of the water to the second manifold; and means for mating the diaphragm with the inner wall of the vessel having the channels and with the channels themselves to close the holes in the channels when a predetermined amount of the pressurized fluid acts on the rear side of the diaphragm.

2. The press as claimed in claim 1, wherein the second manifold comprises a series of secondary manifolds which have a delivery side and an inlet side, the delivery side of the secondary manifolds being connected to at least one of the channels and the inlet side being connected to a main manifold by a plurality of pipes, the main manifold being connected to the means for feeding and the pipes having the valve means located therein, the valve means having a plurality of valves. which open in succession for a predetermined adjustable period to admit water from the means for feeding to the second manifold.

3. The press as claimed in claim 1, wherein the valve means comprises a plurality of valves and wherein the second manifold comprises a series of secondary manifolds connected to a series of pipes, each of the pipes having a valve located therein.

4. The press as claimed in claim 3, further comprising control means for successively opening the valves for a predetermined adjustable period to admit water from the means for feeding to the second manifold.

5. The press as claimed in claim 1, wherein the longitudinal channels each have at least one outer side generally parallel to the inner wall of the vessel and at least two sides extending between the at least one outer side and the inner wall of the vessel, the at least one outer side and the at least two sides of the channels each having the plurality of holes defined therein.

6. The press as claimed in claim 1, wherein the longitudinal channels are generally parallel to the longitudinal axis of the vessel.

* * * * *